US006036186A

United States Patent [19]

Glanzmann et al.

[11] Patent Number: 6,036,186

[45] Date of Patent: Mar. 14, 2000

[54] FEEDING DEVICE FOR PRINTED PRODUCTS

[75] Inventors: Alfred Glanzmann, Reiden; Kurt Heutschi, Wikon, both of Switzerland

[73] Assignee: Grapha-Holding AG, Hergiswil, Switzerland

[21] Appl. No.: 08/955,171

[22] Filed: Oct. 21, 1997

[30] Foreign Application Priority Data

Oct. 24, 1996 [CH] Switzerland ..... 2607/96

[51] Int. Cl.[7] ..... B65H 1/02

[52] U.S. Cl. ..... 271/150; 271/152; 271/155

[58] Field of Search ..... 271/149, 150, 271/152, 153, 155, 154

[56] References Cited

U.S. PATENT DOCUMENTS 4,588,180 5/1986 Ballestrazzi et al. ..... 271/155 X
4,595,188 6/1986 Wiley et al. .
5,249,788 10/1993 Helmstädter .
5,284,335 2/1994 Golicz .

FOREIGN PATENT DOCUMENTS 584642 2/1977 Switzerland .

*Primary Examiner*—David H. Bollinger
*Attorney, Agent, or Firm*—Friedrich Kueffner

[57] ABSTRACT

A feeding device for printed products including a conveyor for conveying the printed products on a front conveying section in the form of a stack and on a rear conveying section in the form of a bar and in the form of a loosened zone between the stack and the bar, and a sensing device which senses the position of the stack and controls the feeding movement of the printed products. The rear conveying section includes a continuously advanced conveying device which is controlled by an intermittently advanced conveying device of the front conveying section.

12 Claims, 2 Drawing Sheets

FEEDING DEVICE FOR PRINTED PRODUCTS

BACKGROUND OF THE INVENTION

1. Field of the Invention

The present invention relates to a feeding device for printed products including a conveyor for conveying the printed products on a front conveying section in the form of a stack and on a rear conveying section in the form of a bar and in the form of a loosened zone between the stack and the bar, and a sensing device which senses the position of the stack and controls the feeding movement of the printed products.

2. Description of the Related Art

A device of the above-described type is disclosed in Swiss Patent No. 584,642. This device has been found useful in practice as a feeding mechanism for a feeder for a gathering machine.

In the known device, a tip senses the position of the stack and controls the feeding movement of the printed products in this manner. The feeding movement is effected through eccentric members or cams which must be of very robust construction because the paper to be moved during feeding may have a high weight of 200 to 300 kg.

For some time, there has now been a demand for a higher feeding speed which should exceed about 24,000 units per hour. However, at such high speeds, the mechanical load cannot be controlled in the case of thick printed products. Also, due to the different compressibility of the paper in the bars and when removing an end plate, differences occur in the feeding movements between stack and bar. It is possible to partially compensate these differences by a mechanical transmission into slow or fast feeding movements of intermediate stack and bar. However, if this transmission is not precisely adjusted to the type of paper, problems may occur. These problems may be that the bar can sink or the pressure in the stack becomes so high that the operation of the feeder is no longer ensured. In addition, it is desirable that such a device can also be used for very thick products having, for example, 96 or more pages, as well as for extremely thin four-page sheets.

SUMMARY OF THE INVENTION

Therefore, it is the primary object of the present invention to provide a device of the above-described type which is capable of processing very thin sheets as well as very thick sheets at higher speeds, while still being capable of being operated so as to function safely.

In accordance with the present invention, the rear conveying section includes a continuously advanced conveying means which is controlled by an intermittently advanced conveying means of the front conveying section.

Accordingly, in the device according to the present invention, an intermittent feeding of the stack is combined with a continuously operating feeding of the bar. This makes it possible to correct the feeding speed differences between the feeding movements of the stack and the bar during operation. It is also important that loosening of the stack in the loosened zone is independent of the feeding movement of the bar.

The device according to the present invention makes it possible to process sheets of up to 120 pages at speeds of 30,000 units per hour. The previously feared pawl breakage can be essentially avoided.

In addition, the device according to the present invention has the following advantages.

It is not necessary to provide a mechanical transmission between the stack feeding section and the bar feeding section. The bar feeding section can be easily and quickly changed over. The drive can be easily integrated into the bar feeding section, so that extensive prior investments, for example, in a feeder, are not required. Since the bar feeding movement can be independent up to the loosened zone, it is possible to loosen the printed sheets in an optimum manner. The speed ratio between stack feeding movement and bar feeding movement can be influenced during operation. It is also important that sinking of the sheets and the build-up of an excessively high stack pressure can be prevented. The stack feeding mechanism can be constructed so as to be very sensitive and also inexpensively with a freewheel as the basic equipment for a feeder.

The stack may essentially be a vertical stack or also a scaled stream. In the first case, the device is particularly suitable for feeding a feeder, for example, of a gathering machine. If the stack is in the form of a scaled stream, flat stacks can be formed, for example, in a so-called inlet, or bundles can be formed in a stacker. It is also conceivable to use the device for feeding printed products to other devices.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figures 1, 2:
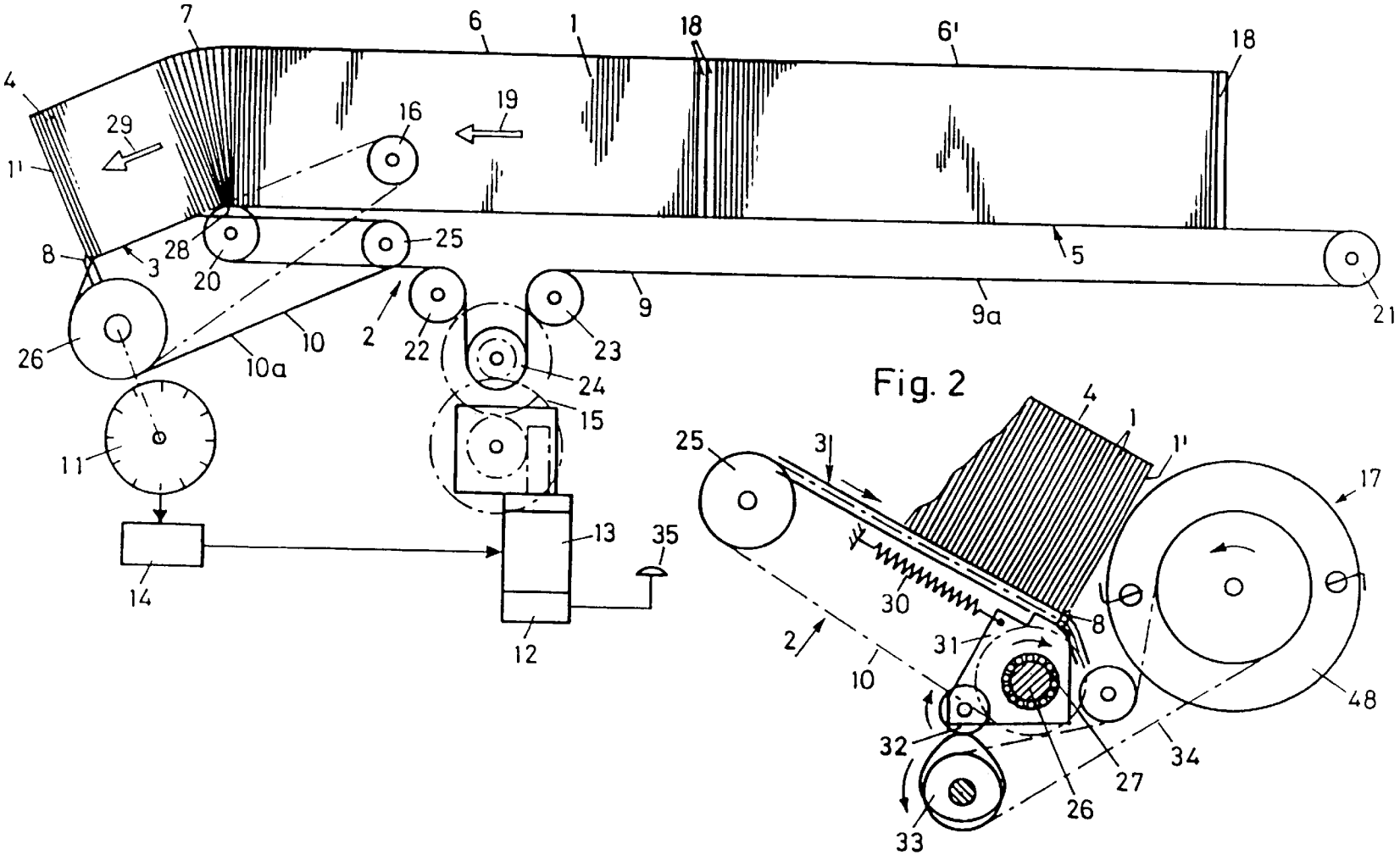
FIG. 1 is a schematic illustration of a first embodiment of the feeding device according to the present invention.
FIG. 2 schematically shows a portion of the device of FIG. 1 with a feeder.

The device schematically illustrated in FIGS. 1 and 2 includes a front conveying section 3 and a rear conveying section 5 for conveying printed products in the direction of arrow 19, for example, for feeding a feeder 17 shown in FIG. 2. In the area of the rear conveying section 5, the printed products 1 form a bar 6 which may be followed by an additional bar 6' provided with end plates 18. In the bar 6, the front end plate has already been removed. The bars 6 and 6' have been removed from an intermediate storage means, not shown, where the bars are pressed and bound between the end plates with a length of about 1.2 m. Consequently, the printed products 1 are arranged relatively densely in the area of the rear conveying section 5.

The conveying section 5 includes a continuously operating conveying unit 9 which is composed of two endless link chains **9*a* which are arranged spaced apart next to each other and are placed around guide rollers 20 to 23 and a drive roller 24. In FIG. 1, only the front link chain 9*a*** is visible.

The drive roller 24, which is provided with chain wheels, not shown in detail, for the engagement of the link chains **9*a*, is connected to a motor 13 through a spur gear unit 15 which cooperates with a worm gear unit 15***a*. The motor 13 preferably is a frequency-regulated gear motor. The motor 13 and the gear unit 15 form a continuous drive for the conveying unit 9.

The front conveying section 3 is formed by a substantially shorter conveying unit 10 which also is composed of two link chains 10*a* arranged spaced apart at a distance from each other. The link chains 10*a* are placed at a rearward end 16 of the conveying unit 10 approximately vertically about a swingable guide roller 25. A drive shaft 26 with a freewheel 27 is provided for driving the link chains 10*a*.

As shown in the drawing, the front conveying section 3 is slightly inclined and forms at the front end of the rear conveying section a bend 28 above which a loosened zone 7 of printed products 1 is formed at the front end of the bar 6. A slightly inclined stack 4 is formed in the area of the front conveying section 3 following the zone 7 and behind a sensing tip 8 shown in FIG. 2. In FIG. 1, the conveying direction of the printed products 1 in the stack 4 is indicated by arrow 29. As shown in FIG. 2, the sensing tip 8, which is known in the art, is pressed by means of a tension spring 30 against the stack 4. When the frontmost printed sheet 1' which has previously been separated from the stack 4 is pulled off downwardly by means of a double gripper drum 48, the sensing tip 8 follows the lower edge of the stack 4. Consequently, the sensing tip 8 carries out a short movement toward the left as seen in FIG. 2 and simultaneously rotates a housing 31 about the drive shaft 26 and a cam roller 32 simultaneously moves downwardly. Through the cam roller 32 and the housing 31, the sensing tip 8 is returned into its initial position by means of a cam 33 which rotates in accordance with the machine cycle. The drive of the cam 33 is effected through an endless drive member 34 which is connected to the double gripper drum 48. The rotary movement of the housing 31 which returns the sensing tip 8 into the initial position is transmitted through the freewheel 27 to the conveying unit 10 which advances the stack 4 accordingly. Consequently, the conveying unit 10 is intermittently driven in accordance with the machine cycle. The conveying unit 10 is capable of carrying out, for example, up to 30,000 feeding movements and, thus, 30,000 printed products 1 are fed per hour to the double gripper drum 48.

The shaft 26 is connected to an incremental rotary pick-up 11 which measures the feeding movement of the conveying unit 10 at the drive shaft and transmits the measured values to a regulator 14. The regulator 14 is electrically connected to the control 12 of the motor 13. The regulator 14 computes during a certain time period an analog desired value for the drive 13 from the increments received from the pick-up 11. When the feeding speed of the conveying unit 10 changes, the number of increments are changed accordingly, and, thus, the corresponding analog desired value for the drive 13 is changed. By increasing this desired value, it is now possible to very precisely influence and adjust the speed ratio between the front conveying section 3 and the rear conveying section 5. When the analog desired value drops due to a longer interruption below a certain minimum value, feeding of the rear conveying unit 9 is interrupted until the increments for the minimum analog desired value have been summed up. This regulating procedure makes it possible to safely deal with longer interruptions in the feeding of the stack, for example, as a result of a so-called selective binding. The drive 13 can also be actuated manually by pressing a button on the switch 35. This makes it possible to easily and quickly close even larger gaps in the rear conveying section 5.

As is apparent from the above explanations, it is now possible to influence the speed ratio between the conveying unit 9 and the conveying unit 10 during operation. The rotary pick-up 11 is very sensitive and, thus, changes in the feeding speed of the stack 4 can be taken into consideration very quickly and easily during the continuous feeding of the conveying unit 9. This makes it possible to prevent an excessive loosening of the bar 6 and, thus, sinking-in of the printed products 1, and the build-up of an excessive pressure in the bar 6 is also avoided. Since feeding of the conveying unit 9 is independent up to the bend 28, the printed products can be loosened in an optimum manner in the loosened zone 7.

Figure 3:
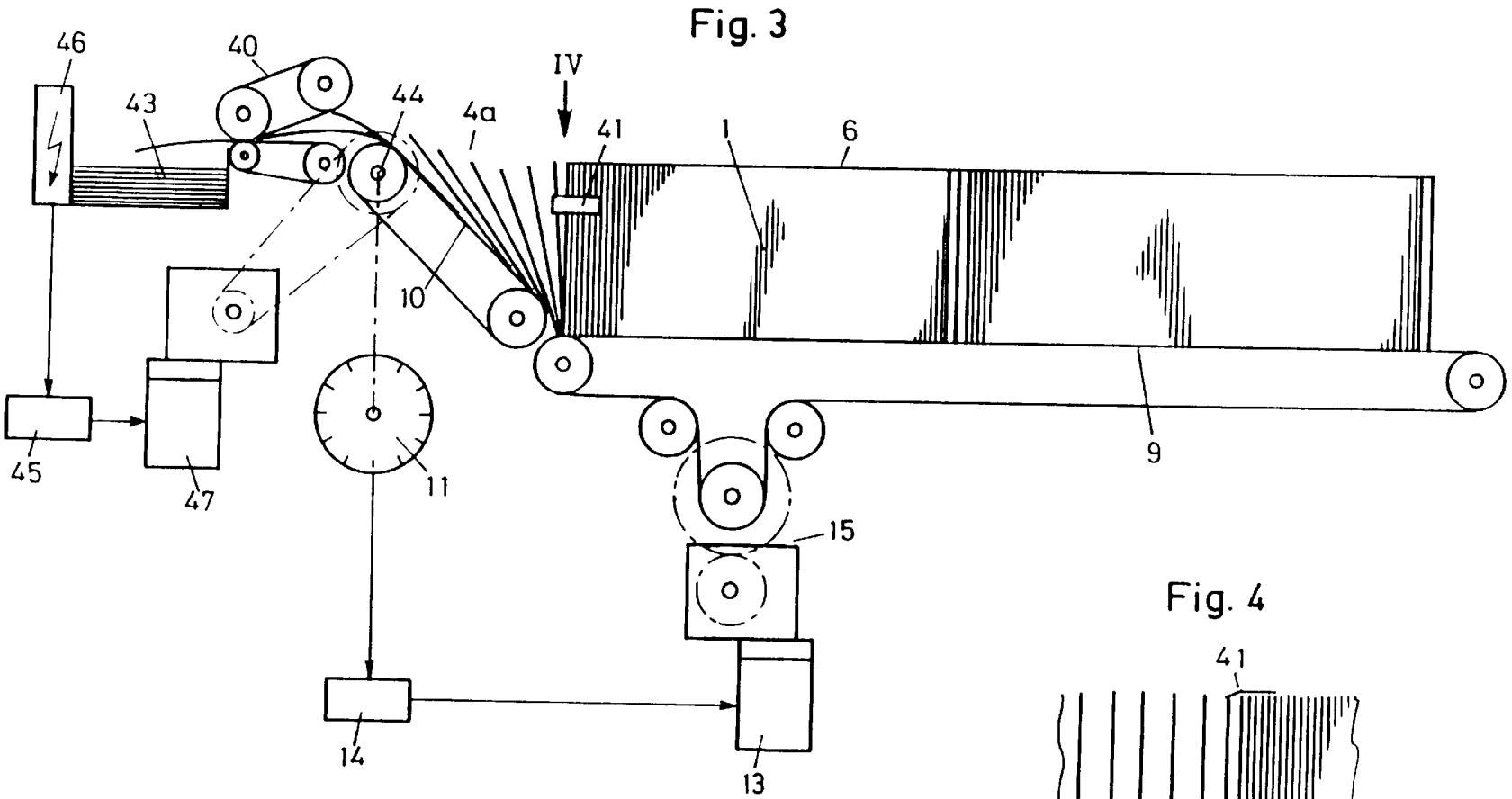
FIG. 3 is an illustration of a second embodiment of the feeding device according to the present invention.
Figure 4:
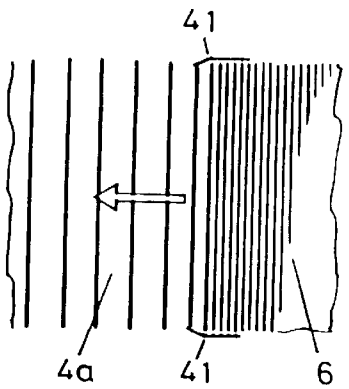
FIG. 4 is a top view of a detail of the device of FIG. 3 in the direction of arrow IV of FIG. 3.

FIGS. 3 and 4 of the drawing show another embodiment of the feeding device for feeding printed products 1 in which the intermittently operating conveying unit 10 is inclined upwardly and the printed products 1 are transferred in the form of a scaled stream 4*a* to an accelerator belt 40. For forming the scaled stream 4*a*, two lateral retaining members 41 are arranged at the front of the bar 6 for individually spreading out the printed products 1 of the bar, so that the printed products 1 form a scaled stream 4*a* on the conveying unit 10.

The accelerator belt 40 has a separate drive, not shown in the drawing, and transfers the printed product 1 to a conventional stack 42 in which bundles 43 are formed from the printed products 1. The incremental rotary pick-up 11 is connected to the drive shaft 44 of the conveying unit 10 and also to the regulator 14. Another regulator 45 is arranged between a level indicator 46 and a gear motor 47. The gear motor 47 drives the conveying unit and is controlled by the level control device 46. The manner of operation of this embodiment is otherwise the same as that of the embodiment described above.

The invention is not limited by the embodiments described above which are presented as examples only but can be modified in various ways within the scope of protection defined by the appended patent claims.

We claim:

1. A feeding device for feeding printed products comprising a conveyor having a front conveying section for conveying the printed products in the form of a stack and a rear conveying section for conveying the printed products in the form of a bar and a loosening zone between the stack and the bar, a sensing device for sensing a position of the stack and means for controlling a feeding movement of the printed products, wherein the rear conveying section comprises a continuously advanced conveying unit and the front conveying section comprises an intermittently advanced conveying unit, and wherein the intermittently advanced conveying unit comprises means for controlling the continuously advanced conveying unit.

2. The feeding device according to claim 1, comprising a pick-up connected to the intermittently advanced conveying unit, wherein the pick-up comprises means for measuring feeding movement effected by the intermittently advanced conveying unit.

3. The feeding device according to claim 2, wherein the pick-up is an incremental rotary pick-up.

4. The feeding device according to claim 2, wherein the drive of the continuously advanced conveying unit comprises a frequency-regulated gear motor.

5. The feeding device according to claim 2, further comprising a regulator for computing an analog desired value for the drive of the continuously advanced conveying unit from a travelled distance of the intermittently advanced conveying unit.

6. The feeding device according to claim 5, comprising means for indicating the travelled distance by a corresponding number of increments.

7. The feeding device according to claim 6, comprising means for interrupting feeding of the continuously advanced conveying member when the desired value drops below a certain minimum value, until the increments for the minimum desired value have summed up.

8. The feeding device according to claim 2, wherein the drive for the continuously advanced conveying unit comprises a gear unit with a switchable transmission.

9. The feeding device according to claim 1, comprising means for manually actuating the continuously advanced conveying unit.

10. The feeding device according to claim 1, wherein the intermittently advanced conveying unit comprises a rearward end configured to be foldable upwardly and downwardly.

11. The feeding device according to claim 1, wherein the feeding device is connected to a feeder for a gathering machine.

12. The device according to claim 1, wherein the stack comprises a scaled stream of printed products.

* * * * *